US005333410A

United States Patent [19]

Tetherton

[11] Patent Number: 5,333,410

[45] Date of Patent: Aug. 2, 1994

[54] CONTROLLABLE BARRIER SYSTEM FOR PREVENTING UNPAID ADMISSION TO A FEE-PAID AREA

[75] Inventor: Cyril F. Tetherton, Poway, Calif.

[73] Assignee: Cubic Automatic Revenue Collection Group, San Diego, Calif.

[21] Appl. No.: 6,979

[22] Filed: Jan. 21, 1993

Related U.S. Application Data

[63] Continuation of Ser. No. 633,602, Dec. 19, 1990, abandoned.

[51] Int. Cl.[5] ..... E05B 65/00

[52] U.S. Cl. ..... 49/35; 49/49; 49/25

[58] Field of Search ..... 49/13, 31, 35, 49, 340, 49/50, 67, 25

[56] References Cited

U.S. PATENT DOCUMENTS

| | | | |
|---|---|---|---|
| 3,169,329 | 2/1965 | Powers | 49/394 X |
| 3,221,304 | 11/1965 | Enikeieff et al. | 49/35 X |
| 3,386,202 | 6/1968 | Crews et al. | 49/35 |
| 3,478,467 | 11/1969 | May | 49/35 |
| 3,606,698 | 9/1971 | Tanaka et al. | 49/35 |
| 3,609,914 | 10/1971 | Berl | 49/25 |
| 3,753,317 | 8/1973 | Turpin et al. | 49/35 |
| 3,913,717 | 10/1975 | Collins | 49/25 X |
| 4,866,881 | 9/1989 | Morrow et al. | 49/25 |
| 4,967,083 | 10/1990 | Kornbrekke et al. | 49/25 X |
| 5,056,261 | 10/1991 | Tetherton | 49/35 X |

FOREIGN PATENT DOCUMENTS

| | | | |
|---|---|---|---|
| 2128758 | 9/1978 | Fed. Rep. of Germany | 49/49 |
| 2540927 | 8/1984 | France | 49/25 |

*Primary Examiner*—Peter M. Cuomo
*Assistant Examiner*—Jerry Redman
*Attorney, Agent, or Firm*—Brown, Martin, Haller & McClain

[57] ABSTRACT

A barrier system works in conjunction with an automatic fee collection system to prevent persons from gaining entry to a fee-paid area without payment of the required fee. The barrier system includes a physical barrier that controllably blocks a passageway through which the person who attempts to gain access without payment must move. A barrier actuator controllably drives the physical barrier from the open to the closed position under the direction of a controller. The controller receives sensor signals that warn of an attempt to gain admission without payment, processes those signals through a logic that prevents unauthorized admission, guards against injury to persons by operation of the physical barrier, and permits exit through the barrier system. In a preferred approach, the automatic fee collection system includes a passageway through which persons must pass to gain admission, and the barrier system includes a passageway extension which is blocked when a person attempts to gain admission without payment.

13 Claims, 2 Drawing Sheets

CONTROLLABLE BARRIER SYSTEM FOR PREVENTING UNPAID ADMISSION TO A FEE-PAID AREA

This is a continuation of application Ser. No. 07/633,602, filed Dec. 19, 1990, now abandoned.

This invention relates to automatic fee collection systems, and, more particularly, to a barrier system that prevents persons from defeating an automatic fee collection system and gaining unauthorized access to a fee-paid area.

Automatic fee collection systems are widely used in transit systems such as subways. When such a system is used properly, a person who wishes to gain admission to a fee-paid area deposits the correct fee or uses a fee card (such as a credit card) to make payment, and then moves into the fee paid area. Automatic fee collection systems can also be used to register fees paid previously and permit entry premised upon those prior payments. When no fee is or has been paid, the person may not gain admission. Automatic fee collection systems are expected to gain increasing acceptance and use in other applications, such as, for example, toll roads and admissions to events such as sporting events.

The automatic fee collection systems often work unattended, with minimal surveillance, or in crowded situations where many people are seeking to gain entry to the fee-paid areas. Unfortunately, under these conditions some small fraction of persons attempt to gain entry to the fee-paid area without payment, by defeating the automatic fee collection system. One common example experienced by many transit systems using automatic fee collection equipment with a turnstile entry is the person who simply vaults over the turnstile and disappears into the crowd in the fee-paid area.

It is very difficult to prevent such unpaid entries unless a full-time guard is stationed in the fee-paid area near the automatic fee collection system, thereby sacrificing one of the major cost-reduction advantages of the automated system. Even then, if a person making an unpaid entry is caught there is little by way of penalty that can be assessed, because the amount of the "theft" of services is usually only a dollar or less. Although the fraction of such persons who attempt to gain unauthorized entry is a very small part of the total number of users, in large transit systems the loss due to unauthorized entry may be millions of dollars per month.

There is a need for an approach to reduce, and desirably prevent entirely, the unpaid entry of persons to fee-paid areas through automatic fee collection systems. Such an approach must be operable to prevent such entries, but must also be compatible with other requirements for the automatic fee collection system. For example, in a mass transit system the automatic fee collection system must not only permit authorized entry and prevent authorized entry, but must also permit exit from the fee-paid area under all conditions, such as when there is a fire. The safety of all persons using the transit system, even those who are attempting to defeat the automatic fee collection system, is of paramount importance, and must be ensured by the approach for preventing unpaid admissions.

The present invention fulfills this need, and further provides related advantages.

SUMMARY OF THE INVENTION

The present invention provides an apparatus for preventing unpaid admissions to a fee-paid area of an automatic fee collection system. It permits unobstructed passage of persons who properly pay the fee, prevents passage of persons who have not paid the fee, and permits exit of persons from inside the fee-paid area through the automatic fee collection system even when there is a person attempting to defeat the system. The apparatus of the invention is structured primarily to physically bar entry of persons attempting to defeat the automatic fee collection system, rather than to capture them, although the apparatus can be made to perform such capture or sound an alarm. The apparatus includes safeguards against injuring the person who is attempting to defeat the system.

In accordance with the invention, apparatus for preventing unpaid admission to a fee-paid area through an automatic fee collection system, which includes means for automatically collecting fees, the means for automatically collecting fees including a passageway through which persons seeking to gain admission to the fee-paid area must pass, comprises barrier means for preventing entry to the fee-paid area in the event that no fee is paid, the barrier means including a movable physical barrier that controllably blocks a passageway of a means for automatically collecting fees, a barrier actuator system that moves the physical barrier from an open position in which it does not block the passageway to a closed position in which it does block the passageway, sensor means for detecting attempted entry into the fee-paid area through the passageway without payment of the required fee, and control means for operating the barrier actuator to move the barrier from the open position to the closed position, the control means requiring at least two control conditions to operate, a signal from the sensor means indicating attempted entry without payment of the required fee, and no signal from the means for automatically collecting fees indicating that the required fee has been paid.

The automatic fee collection system includes a passageway through which persons must move to gain admission to the fee-paid area. The automatic fee collection system usually has walls on either side so that there is no reasonable alternative to gaining entry without passing through the passageway. In one such automatic fee collection system, the person who gains admission properly walks up to an entry port, makes or registers payment, and then pushes forward through a turnstile. There are cabinets placed on either side of the turnstile that define the passageway.

With this arrangement, the person who attempts to defeat the system may crawl under the turnstile or vault over the turnstile. (Other approaches to defeating the automatic fee collection system such as the use of slugs or squeezing two persons through the turnstile with payment for only one are important problems, but are beyond the scope of the present invention, except that these events can be made to operate the barrier means.) The apparatus of the invention provides the physical barrier that can operate sufficiently rapidly upon command of the control system to bar the person attempting to gain entrance without proper payment. The barrier is preferably inserted into a passageway extension 1–2 feet along the passageway from the turnstile of the automatic fee collection system, at a speed and with a movement such that a person cannot traverse the passage and passageway extension before the barrier closes. In the preferred approach, an articulated hinge is employed to swing the barrier into place across the passageway extension.

The control system signals the actuator to close the barrier based upon sensor inputs found appropriate to the detection of persons seeks to gain entry without payment. For example, a first entry sensor can be placed at the entry port to signal that a person has approached the system. A second entry sensor can be placed immediately after the turnstile in the passageway to signal that a person has reached that position. A sensor can be placed above the turnstile to indicate a person vaulting the turnstile, and below the turnstile to indicate a person crawling under the turnstile. Weight sensors can be used under the passageway to indicate the total weight sought to be moved through the passageway. An important virtue of the present system is that the control system is "expandable" to permit additional sensor inputs and control strategies as experience is gained on techniques devised by persons to defeat the system.

The sensor system also can include a sensor on the fee-paid side of the apparatus, to detect persons who are leaving the fee-paid area through the passageway. In many transit systems, and particularly those that require the use of an exit card, system users must leave the fee-paid area by traversing back through the automatic fee collection system in the direction opposite to the entry direction. Unauthorized attempts at entry cannot be permitted to prohibit exiting from the system by the users, and the fee-paid side sensor provides a signal that a person is leaving the system through the automatic fee collection apparatus.

Testing of the apparatus of the invention establishes that it significantly reduces unpaid admissions to the fee-paid area, without damage or injury to persons, and also permits proper exit from the fee-paid area during both regular business and emergencies. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
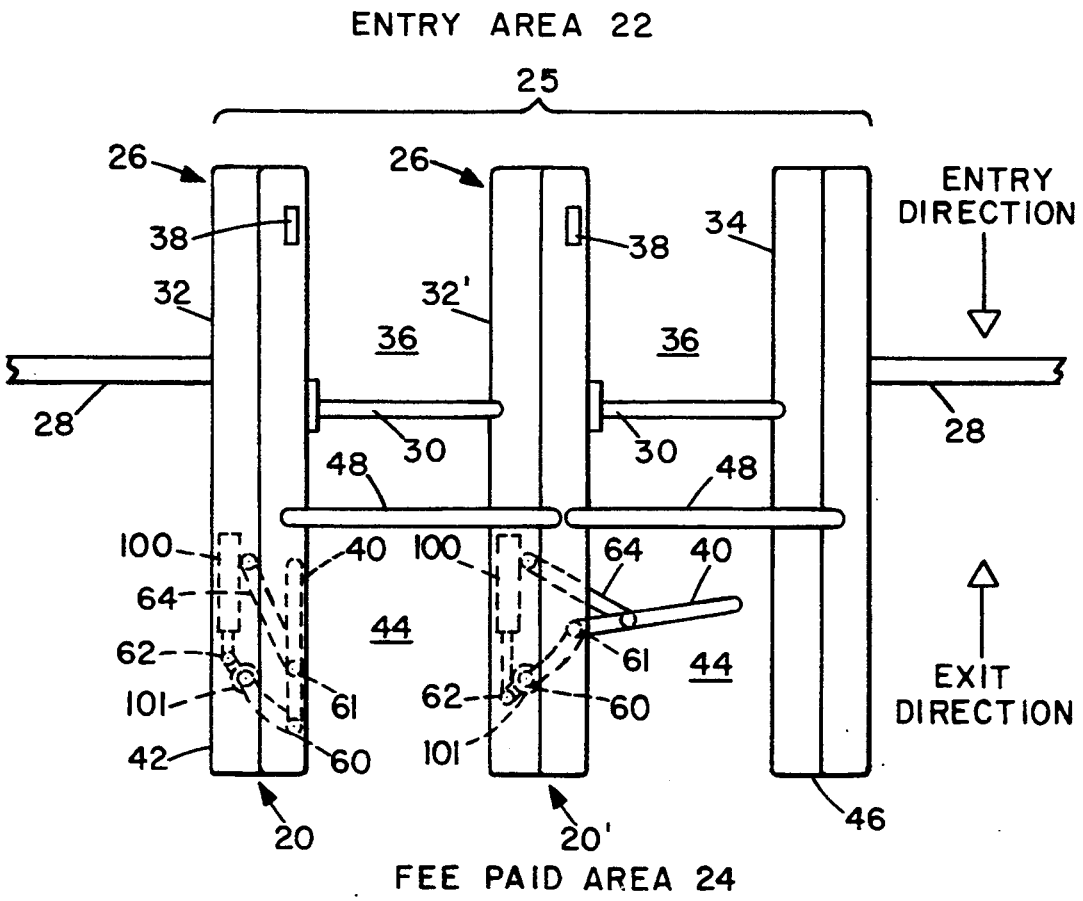
FIG. 1 is a plan view of an entry region to a fee-paid area through an automatic fee collection system.

FIG. 1 presents a general plan view of an apparatus 20 for preventing unpaid admission from an entry area 22 to a fee-paid area 24 through an entry/exit area 25 having an automatic fee collection system 26. Each individual apparatus 20 is associated with an individual automatic fee collection system 26, and in FIG. 1 two pairs of apparatus 20/system 26 are depicted within the entry/exit area 25 in order to show how adjacent equipment interrelates. Impassable walls 28 are erected on either side of the entry/exit area 25 so that persons desiring to enter the system, either with or without payment of the required fee, must pass through the entry/exit area 25.

The physical design of the apparatus 20 for preventing unpaid admission is selected to be structurally and dimensionally compatible with the design of the system 26. The automatic fee collection system 26 includes a controllable turnstile 30 mounted to a turnstile cabinet 32. Together the turnstile cabinet 32 and the adjacent turnstile cabinet 32' (or an end cabinet 34 for the last system 26 in a row) define a passageway 36 through which a person moves in either an entry direction or an exit direction. A fee-receiving station 38 is mounted on the cabinet 32, for receipt of coins, tokens, or fee cards to gain proper admission to the fee-paid area 24. Turnstile mechanisms are known in the art, see for example, U.S. Pat. Nos. 3,913,717; 3,998,008; and 4,020,927, whose disclosures are incorporated by reference.

In normal operation of the automatic fee collection system 26, a person enters the passageway 36 of the automatic fee collection system 26 from the entry area 22, moving in the entry direction. The person pays the required fee at the fee-receiving station 38. The turnstile 30 is locked against rotation to permit entrance until the required fee has been received. After the fee is paid and recognized, the turnstile 30 is unlocked and the person pushes forward against the turnstile 30. As the turnstile rotates, the person is permitted to move forward further along the passageway 36, toward and eventually into the fee-paid area 24.

A person who wishes to defeat this operation of the automatic fee collection system 26 has several options, one of which is to circumvent the turnstile by crawling under it or vaulting over it. In the conventional automatic fee collection system, this approach is often successful, because the person gives little notice of his intention and can quickly blend into the crowd in the fee-paid area after defeating the fee collection system. After the ride on the transit system is complete, for those cases where there are exit fee cards used the person can avoid that requirement by essentially the same approach.

In accordance with the preferred embodiment of the invention, apparatus for preventing unpaid admission to a fee-paid area through an automatic fee collection system, which includes means for automatically collecting fees, the means for automatically collecting fees including a passageway through which persons seeking to gain admission to the fee-paid area must pass comprises barrier cabinet means for defining a passageway extension through which a person must move to gain admission to the fee-paid area, the barrier cabinet means including cabinets on either side of the passageway extension dimensioned to discourage persons from entering the fee-paid area by any path other than the passageway extension; a movable physical barrier mounted on the barrier cabinet means, the physical barrier being movable from an open position in which a person can move through the passageway extension, to a closed position in which a person cannot move through the passageway extension, the physical barrier being displaced from the automatic fee collection system along the passageway extension by an amount sufficient to permit the physical barrier to close before a person can move from the automatic fee collection system past the physical barrier when it is in the open position; a barrier actuator that controllably moves the physical barrier from the normally open position to the closed position; at least one sensor located along the passageway and passageway extension to detect the presence of a person therein; and a controller that receives a sensor signal from the sensor and a fee collection signal from the automatic fee collection system, includes a logical control sequence that infers the presence of a person seeking to enter the fee-paid area without making payment from the received signals, and sends a closing command to the barrier actuator.

The apparatus 20 includes a movable physical barrier 40 that, under conditions to be discussed more fully below, can be activated to bar entry of the person attempting to defeat the automatic fee collection system 26. The barrier 40 is mounted to a barrier support cabinet 42 which is aligned in an end-to-end fashion with the turnstile cabinet 32 to create a passageway extension 44 through which the person must move to gain admission to the fee-paid area 24. Where there are multiple turnstile cabinets 32, multiple barrier support cabinets 42 are provided in an aligned fashion to define multiple passageway extensions 44, one for each passageway 36. A barrier end cabinet 46 is provided to match to the end cabinet 34.

Figure 2:
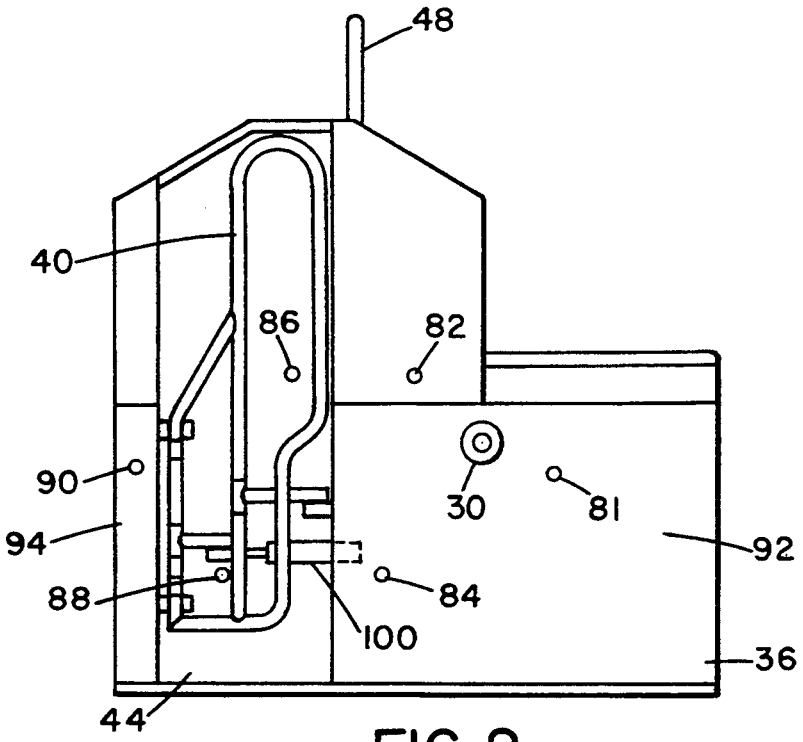
FIG. 2 is a side elevational view of the automatic fee collection system of FIG. 1, with portions removed for clarity.
Figure 3:
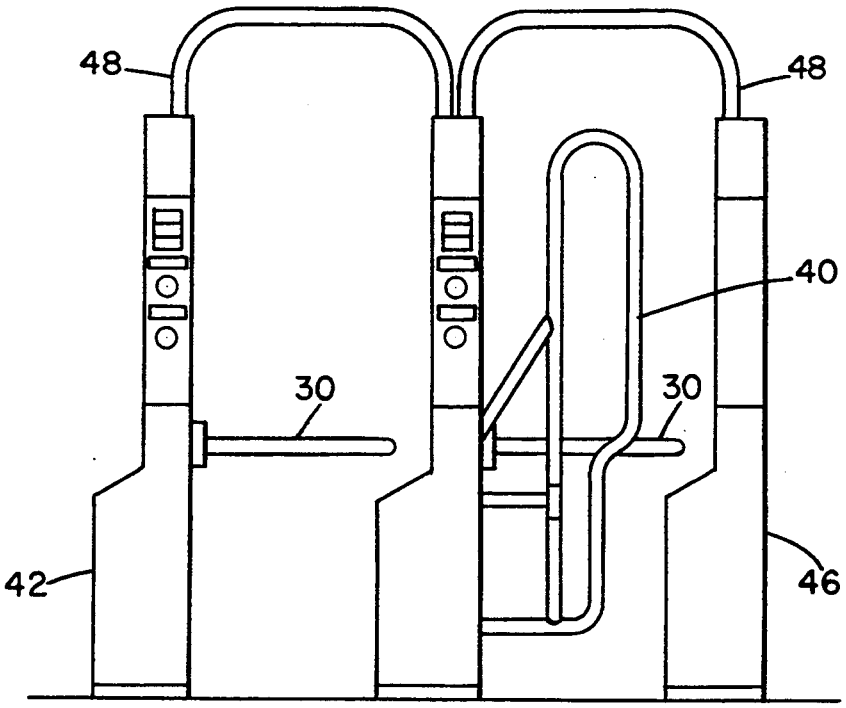
FIG. 3 is an end elevational view of the apparatus for preventing unpaid admissions of FIG. 1, from a point of view in the fee-paid area.

As will be seen from FIGS. 2 and 3, the cabinets 42 and 46 are solid bodies, which prevents entry to the fee-paid area by crawling under the cabinets 42 and 46, and extend upwardly so high that a person cannot vault over them. The only possible path for a person to enter the fee-paid area, whether with or without the payment of the fee, is through the passageway extension 44.

The passageway extension may be controllably blocked by movement of the barrier 40 from an open position illustrated in the leftmost of the apparatus 20 of FIG. 1, to a closed position illustrated in the rightmost of the two apparatus 20 of FIG. 1. In the preferred approach and as most clearly seen in FIG. 3, the barrier 40 is formed of welded steel tubes that extend from a few inches above floor level to nearly 6 feet high. As shown in the rightmost apparatus 20 of FIG. 3, when the barrier 40 is in the closed position, it is virtually impossible to crawl under the barrier or vault over the barrier. In the preferred embodiment shown in FIGS. 2 and 3, an overhead cable way 48 extends upwardly and over each of the passageways 36 between adjacent automatic fee collection systems 26. This cable way 48 provides electronic communication between the systems 26, but additionally provides an obstacle against vaulting over the turnstile 30 and the barrier 40 when it is in the closed position. As is apparent from FIG. 3, the barrier 40 could be readily extended downwardly to the floor and to even greater heights until it nearly touches the cable way 48, but the illustrated preferred structure is thought to provide a sufficient deterrent to attempts to defeat the automatic fee collection system 26 by crawling under or vaulting over it.

One consideration in the construction of the apparatus 20 is that the total length of the cabinets 32 and 42 cannot be so great that the fee collection system occupies too much floor area. The greatest requirement for length in the cabinet 42 is presented by the mechanism for opening and closing the barrier 40. To provide a controllable opening and closing mechanism in a short length of floor space, an articulated pivot approach has been devised.

The barrier 40 is pivotably supported on a pivot link 60 at a primary pivot 61, whose position floats. The pivot link 60 is itself pivotably supported on an actuator pivot 62. In the preferred approach, the pivot link 60 is pivoted (in the clockwise direction in the view of FIG. 1, left hand side apparatus 20) so that the primary pivot 61 is within the cabinet 42 and the barrier 40 is flush with the cabinet face. When the pivot link 62 is pivoted toward the barrier-closed position (in the counterclockwise direction in the view of FIG. 1, right hand side apparatus 20'), the primary pivot 61 moves into the passageway extension 44, thrusting the barrier 40 outwardly into the passageway extension.

An actuator 100 causes the pivot link 60 to pivot about the pivot 62. A ratchet mechanism 101 is preferably provided on the pivot 62 or elsewhere in the system, so that upon actuation of the actuator 100 and closing of the barrier 40, the barrier cannot be reopened without releasing the ratchet. A ratchet solenoid 102 releases the pawl of the ratchet mechanism 101 when the barrier 40 is to be reopened after closing. The solenoid 102 is preferably connected in a failsafe mode, so that upon power failure the ratchet will be released and persons may freely open the barrier 40, whatever other conditions prevail.

A positioning link 64 is pivotably supported at one end within the interior of the cabinet 42 at a location closer to the turnstile 30 than the actuator pivot 62, and at the other end to an intermediate location along the length of the barrier 40. In practice, and as shown in FIG. 3, right hand side, the pivot link 60 is pivotably connected to one of the upright tubes of the barrier 40, and the positioning link is pivotably connected to another of the upright tubes of the barrier 40. The positioning link permits the barrier 40 to be retracted inside the cabinet 42 when the barrier 40 is in the open position, but forces the barrier 40 across the passageway extension 44 into a locked position when the pivot link 60 is actuated. This articulated opening and closing approach permits the barrier 40 to be thrust out into the passageway extension 44 to provide maximum blocking effect, while at the same time requiring minimal length of the cabinet 42 in the open position. (While a sliding barrier could be envisioned that would permit an even shorter cabinet length, the sliding barrier approach is not feasible because in the open position the barrier would have to be retracted into the neighboring passageway.)

Figure 4:
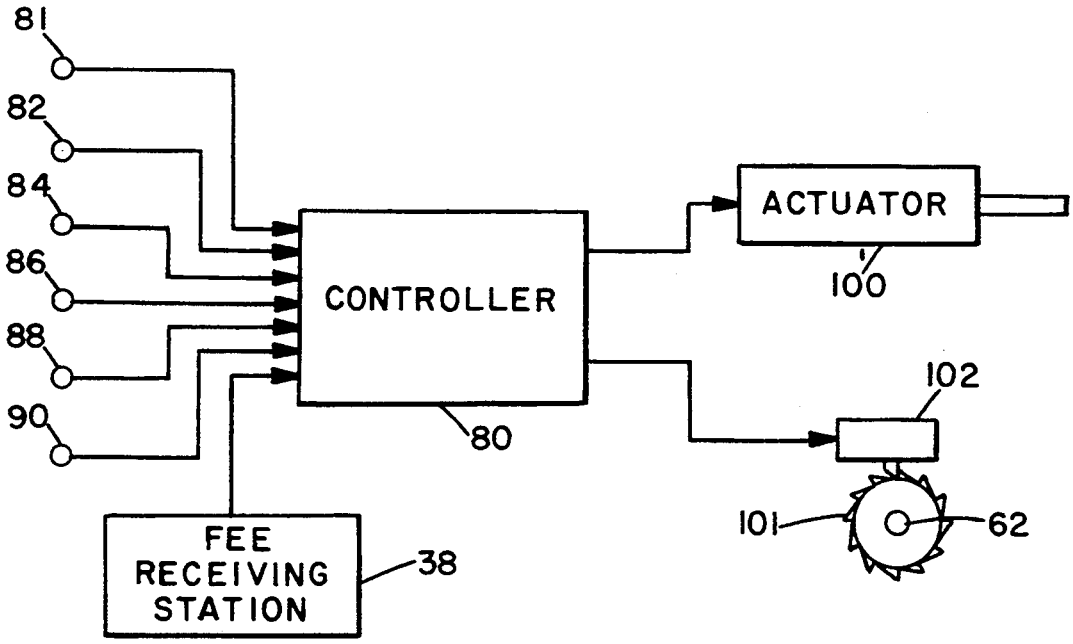
FIG. 4 is a schematic view of the control interrelation of the elements of the apparatus for preventing unpaid admissions.

FIG. 4 illustrates the control system of the apparatus 20. A controller 80 receives signals from at least one, and preferably several sensors, and from the fee receiving station 38 of the automatic fee collection system 26. In the preferred version of the apparatus shown in FIG. 2, six sensors 81, 82, 84, 86, 88, and 90 are shown, but there could be fewer or more, depending upon the types of payment avoidance schemes that persons devise. The controller 80 incorporates a programmable microcomputer, which permits the number and type of sensors to be varied in response to various schemes to defeat the system.

The sensors are located on the system 26 and the apparatus 20 at locations selected to provide information about a person proximate the sensors. Preferably, the sensors are reflective light sensors that sense reflected light from an object, light beams that are broken by a person, ultrasonic transducers that transmit a wave across the respective portions of the passageway, electromagnetic sensors, or even load transducers that sense the weight of a person passing over the sensor. In the illustrated approach and as may be seen best in FIG. 2, the sensor 81 is located at an entry port 92 of the automatic fee collection system 26, and produces an output signal when a person enters the entry port 92. The sensor 82 is located above and behind the turnstile 30, and produces an output signal when a person passes the turnstile, either through the turnstile after proper payment has been made, or if the person vaults over the turnstile without making payment. The sensor 84 is located intermediate the turnstile 30 and the barrier 40, and produces an output signal when a person passes the turnstile, either through the turnstile after proper payment has been made, or if the person attempts to crawl under the turnstile without making payment. The sensor 86 senses the presence of a person in the passageway extension 44, between the turnstile 30 and the barrier 40, but immediately before the barrier 40 is encountered. The sensor 90 senses the presence of a person at an exit port 94. Such a person could be one who has passed through the passageway extension 44 upon entry to the fee-paid area 24, or a person who is leaving the fee-paid area 24 to exit through the passageway extension 44. The sensor 88 senses the presence of a person at the exit side of the barrier 40. In the approach illustrated in FIG. 2, the sensors have been positioned at both low and high locations, to minimize the changes that a person could vault over or crawl under the turnstile arm 30 without detection.

The controller 80 is programmed to analyze the sensor and fee receiving station signals and decide whether a person is attempting entry to the fee-paid area 24 after proper payment has been made, in which case the barrier 40 remains open; whether a person is attempting entry to the fee-paid area 24 without making proper payment, in which case the barrier 40 is moved to the closed position through a signal to the actuator; or whether a person is exiting the fee-paid area 24 through the passageway extension 44, in which case the barrier 40 remains open. A simple logic analysis is to read the sensor 81, to determine that a person has approached the fee collection system 26. If the fee receiving station 38 signals that a proper fee has been received, then the receipt of signals from the sensors 82, 84, and 86 does not result in a determination that the barrier 40 should be closed. On the other hand, if no signal is received from the fee receiving station 38 and a person is sensed by the sensors 82, 84, or 86, the barrier 40 is closed by movement of the actuator 100. When the person attempting to gain entry without payment has withdrawn through the entry port 92, as shown by an absence of the signals from the sensors 84, 86, and 88, then the ratchet release solenoid 102 is activated to permit the barrier 40 to swing back to the open position.

On the other hand, if a person is sensed by the exit port sensor 88 or 90, the barrier 40 will remain open so that the person may exit the fee-paid area 24. If a person is sensed attempting to exit at the same time that a person is sensed attempting to enter with payment of the required fee, the barrier remains open. If a person is sensed attempting to exit at the same time that a person is sensed attempting to enter without payment of the required fee, the barrier may be either closed to prevent the unpaid entry (at the expense of free exit by the person leaving) or retained in the open position so that the person attempting exit may do so (at the possible expense of allowing a person to gain entry without pay). The latter decision is at the discretion of the operator of the system, but it is expected that in most cases the operator will be willing to sacrifice the fee of the person attempting the unpaid entry so that the person attempting exit is not impeded. More complex logic strategies can be devised to prevent teamwork to defeat the fee collection system 26.

The present invention therefore provides a strong deterrent and preventative against persons who would avoid the payment of the proper fee to enter the fee-paid area. Although particular embodiments of the invention have been described in detail for purposes of illustration, various modifications may be made without departing from the spirit and scope of the invention. Accordingly, the invention is not to be limited except as by the appended claims.

What is claimed is:

1. Apparatus for preventing unpaid admission to a fee-paid area, the apparatus comprising:

an elongate passageway through which persons seeking to gain admittance to the fee-paid area must pass in an entry direction and through which persons seeking to exit the fee-paid area must pass in an exit direction, the passageway having opposite, first and second ends;

a turnstile positioned in said passageway;

turnstile locking means for normally locking said turnstile against rotation in said entry direction;

automatic fee collecting means for collecting fees from persons seeking to gain admittance to the fee paid area, including means for producing a control signal indicating that the required fee has been paid;

said turnstile locking means being responsive to a control signal from said fee collecting means to release the turnstile locking means on detection of payment of the required fee;

barrier means in said passageway behind said turnstile and spaced a predetermined distance from said turnstile in said entry direction for preventing entry to the fee-paid area in the event that no fee is paid, the barrier means including:

a normally open movable physical barrier that controllably blocks said passageway, the physical barrier extending from a height sufficiently low that persons cannot crawl under the physical barrier to a height sufficiently high that persons cannot vault over the physical barrier; the barrier being movable between an open position in which it does not block the passageway and a closed position in which it blocks the passageway, and normally being located in the open position;

a barrier actuator system that automatically moves the physical barrier from the open position in which it does not block the passageway to the closed position in which it does block the passageway;

sensor means in the passageway between the turnstile and the physical barrier for detecting the presence of a person in the passageway to detect attempted entry into the fee-paid area through the passageway without payment of the required fee; and control means for operating the barrier actuator to move the barrier from the open position to the closed position, the control means requiring at least two control conditions to operate, the at least two control conditions including a signal from the sensor means indicating the presence of a person in the passageway between the turnstile and the physical barrier and an absence of a control signal from the automatic fee collecting means indicating that the required fee has been paid.

2. The apparatus of claim 1, the barrier means further including second sensor means in the passageway positioned after the physical barrier in the entry direction for detecting the presence of a person in the passageway attempting to exit from the fee-paid area through the passageway in the exit direction.

3. The apparatus of claim 2, wherein the control means requires a third control condition to operate, the third control condition being an absence of a signal from the second sensor means.

4. The apparatus of claim 1, wherein the sensor means includes a first entry sensor that senses the presence of a person prior to entry into the means for automatically collecting fees, and a second entry sensor that senses the presence of a person immediately after movement through the means for automatically collecting fees.

5. The apparatus of claim 1, wherein the movable physical barrier is formed of pipes joined together with opening therebetween so that there is visibility through the physical barrier.

6. The apparatus of claim 1, wherein the movable physical barrier about a vertical axis is supported on a pivot, and movement of the physical barrier from the open to the closed position includes pivoting of the physical barrier.

7. The apparatus of claim 1, wherein the barrier actuator system includes a barrier actuator that operates upon command from the control means, and a mechanical linkage from the barrier actuator to the physical barrier to permit the barrier actuator to drive the barrier from the open to the closed position when it operates.

8. The apparatus of claim 7, wherein the mechanical linkage includes a ratchet that permits the barrier actuator to drive the physical barrier in the direction from the open to the closed position, a controllable solenoid that releases the ratchet upon command from the control means, and means for biasing the physical barrier toward the open position.

9. A controllable barrier system for preventing unpaid admission to a fee-paid area through an automatic fee collection system, comprising:

an elongate passageway through which persons seeking to gain admission to a fee-paid area must pass in an entry direction and through which persons seeking to exit the fee-paid area must pass in an opposite exit direction, the passageway having a first, entrance end and a second, exit end;

fee collecting means at the entrance end of the passageway for automatically collecting fees from persons seeking to gain admittance to the fee paid area, the fee collecting means including means for producing a control signal indicating that the required fee has been paid;

a normally open physical barrier movably mounted in the passageway at a location after said fee collecting means spaced a predetermined distance from said fee collecting means for movement between an open position in which the barrier does not block the passageway and a closed position in which the barrier blocks the passageway, the physical barrier extending from a height sufficiently low that persons cannot crawl under the barrier to a height sufficiently high that persons cannot vault over the physical barrier, and being normally in the open position allowing free passage in the exit direction through the passageway;

a barrier actuator system for automatically moving the barrier between the open and closed positions;

sensor means for detecting entry into the passageway without payment of the required fee; and control means responsive to said sensor means for operating the barrier actuator to move the barrier from the open to the closed position on detection of a person attempting entry without payment of the required fee; and a turnstile positioned in said passageway prior to said barrier in said entry direction, and locking means for normally locking said turnstile, said locking means being responsive to a control signal from said fee collecting means to release the turnstile on detection of payment of the required fee, the barrier being spaced a predetermined distance from said turnstile to permit closure of said barrier in sufficient time to block the passageway on detection of a person attempting to enter the passageway without payment.

10. The system as claimed in claim 9, wherein the sensor means includes a sensor located in the passageway after the automatic fee collecting means for detecting the presence of a person in the passageway, and the control means is responsive to the presence of at least two control conditions to move the barrier into the closed position, the two control conditions comprising an output from said sensor indicating the presence of a person in the passageway and the absence of a control signal from said fee collecting means indicating that the required fee has not been paid.

11. The system as claimed in claim 9, wherein said sensor means includes at least one sensor in said passageway between said turnstile and said barrier to detect the presence of a person in said passageway, and said control means is responsive to detection of a person in said passageway together with the absence of a control signal from said fee collection means to operate said barrier actuator to close said barrier.

12. The system as claimed in claim 9, wherein said barrier has a height equal to at least the height of an average adult, and has a lower end at or close to floor level.

13. The system as claimed in claim 9, wherein said sensor means comprises a first sensor in said passageway between said turnstile and said barrier to detect the presence of a person in said passageway, a second sensor means is provided in said passageway between said barrier and said exit end of said passageway to detect the presence of a person moving from said fee-paid area in said exit direction through said passageway, said control means being responsive to signals from said fee collecting means, said first sensor, and said second sensor means to close said barrier only when a person is detected in said passageway between said turnstile and said barrier without payment of a required fee and no person is detected in said passageway behind said barrier attempting to exit said fee paid area, whereby persons may freely exit said fee-paid area via said passageway at all times.

* * * * *

UNITED STATES PATENT AND TRADEMARK OFFICE

CERTIFICATE OF CORRECTION

PATENT NO. : 5,333,410

DATED : August 2, 1994

INVENTOR(S) : CYRIL F. TETHERTON

It is certified that error appears in the above-indentified patent and that said Letters Patent is hereby corrected as shown below:

- COLUMN 9, CLAIM 6, LINE 27, AFTER "BARRIER", DELETE "ABOUT A VERTICAL AXIS";
- COLUMN 9, CLAIM 6, LINE 30, AFTER "BARRIER", INSERT --ABOUT A VERTICAL AXIS--.

Signed and Sealed this

Twenty-first Day of March, 1995

*Attest:*

*Attesting Officer*

Bruce Lehman

BRUCE LEHMAN

*Commissioner of Patents and Trademarks*